United States Patent [19]

Maack et al.

[11] Patent Number: 4,888,867

[45] Date of Patent: Dec. 26, 1989

[54] METHOD OF MANUFACTURING ELECTRICAL HARNESSES

[75] Inventors: Werner Maack, Seeheim; Michael Gerst, Worms; Manfred Liedloff, Dieburg, all of Fed. Rep. of Germany

[73] Assignee: AMP Incorporated, Harrisburg, Pa.

[21] Appl. No.: 795,281

[22] Filed: Nov. 5, 1985

Related U.S. Application Data

[63] Continuation-in-part of Ser. No. 551,621, Nov. 14, 1983, Pat. No. 4,559,702.

[51] Int. Cl.[4] ..... H01R 43/00

[52] U.S. Cl. ..... 29/857; 29/861; 29/863

[58] Field of Search ..... 29/857–867, 29/749, 748, 751, 752, 753, 754

[56] References Cited

U.S. PATENT DOCUMENTS

| | | | |
|---|---|---|---|
| 3,416,213 | 12/1986 | Cootes | 29/203 |
| 3,583,055 | 6/1971 | Hammond | 29/753 X |
| 4,308,659 | 1/1982 | Brandewie et al. | 29/748 |
| 4,372,041 | 2/1983 | Winkleman | 29/747 |

*Primary Examiner*—Joseph M. Gorski

*Attorney, Agent, or Firm*—Bruce J. Wolstoncroft; Thomas G. Terrell; Frederick W. Raring

[57] ABSTRACT

A method of manufacturing electrical harnesses is disclosed in which wires are fed through a loading zone and then clamped in the loading zone in side-by-side parallel relationship in an array. The wires are then cut and the clamped array of wires is moved laterally of the axes of the wires past a succession of crimping machines or the like. At each of the machines, a preselected wire is moved axially from the array so that its end is presented to the machine and a terminal is crimped onto the wire. The method of the invention is capable of producing harnesses comprising a plurality of discrete wires having different types of discrete terminals on their ends.

7 Claims, 11 Drawing Sheets

2
14
130
6
114
118
126
135
115
8
92
30
6
7

METHOD OF MANUFACTURING ELECTRICAL HARNESSES

RELATIONSHIP TO PREVIOUS U.S. APPLICATIONS

This application is a Continuation-in-Part of Application Ser. No. 551,621 filed Nov. 14, 1983 and now U.S. Pat. No. 4,559,702.

FIELD OF THE INVENTION

This invention relates to methods of manufacturing electrical harnesses of the type comprising a plurality of discrete wires having discrete terminals crimped onto the ends of the wires.

BACKGROUND OF THE INVENTION

A commonly known method of manufacturing electrical harnesses is to feed wires for the harnesses from a plurality of wire sources, such as reels or barrels, through a clamping zone and after completion of the feeding step, clamping the wires in side-by-side parallel relationship in an array. The wires are then cut at a location close to the zone in which they are clamped and the array of wires is then moved laterally of the axes of the wires and presented to a processing machine. The processing machine may, for example, be an insulation stripping machine or it may be a machine for inserting all of the wires simultaneously into the terminals in a multicontact electrical connector. Both ends of the wires fed from the sources can be similarly treated so that a harness can be produced having a multicontact electrical connector at each end thereof.

The method of manufacturing harnesses as described above requires processing machines (insulation stripping machines or connector applying machines) which are capable of being used under circumstances where the ends of the wires are in alignment with each other and the individual wires are relatively close to each other. This known method can thus be used to simultaneously insert all of the wires into the terminals in a multicontact electrical connector in the known manner. However, it is not usually practical to crimp discrete terminals onto the ends of the wires. If a harness is required which has different types of discrete terminals on the ends of the wires, each terminal must be crimped onto the wire in a separate crimping operation and it is necessary to have a certain amount of clearance around the wire in order to provide room for the crimping dye and anvil. Thus, an array of closely spaced wires cannot be presented to such a crimping press or other processing machine.

The present invention is directed to the achievement of an improved method which permits the crimping of discrete terminals onto the ends of the individual wires in the array.

THE INVENTION

In the practice of the method of the invention, a plurality of discrete wires are fed from substantially endless wire sources through and beyond a first loading zone with the wires in side-by-side coplanar parallel relationship in the loading zone. After completion of the wire feeding step, the wires are clamped in a first array and are cut at a location upstream, relative to the direction of wire feeding, from the first loading zone so that the cut wires have first and second ends, the first ends being adjacent to the first loading zone. Thereafter, the array of wires is intermittently moved laterally of the axes of the wires along a first conveying path past a succession of first wire processing machines such as terminal crimping machines and the array is stopped at each of the machines. While the array of wires dwells adjacent to one of the machines, a preselected wire is moved axially from the array towards the machine and an operation, such as a terminal crimping operation, is performed on the preselected wire. The preselected wire is then retracted into the array and the array is again moved laterally to the next processing machine.

In accordance with further embodiments of the invention, the wires are fed past the first loading zone to a second loading zone and are clamped at the second loading zone in a second array with the second ends of the wires spaced from the location of clamping. In accordance with this embodiment, the second and first arrays of wires can be moved in unison laterally of their axes and a second plurality of processing machines can be provided adjacent to the second array of wires so that discrete terminals can be crimped onto the second ends of the wires. During the feeding step, varying amounts of wires can be fed so that the finished harness can be composed of wires of varying lengths and the wires may be of different diameters if desired. Also in accordance with the invention, the first ends or the second ends can be connected to the terminals in a single multicontact electrical connector in the known manner so that the finished harness has a multicontact electrical connector on one end thereof and has discrete terminals on the wires at the other end thereof.

DRAWING FIGURES

FIG. 12 is a perspective view of one type of harness.

THE PREFERRED EMBODIMENT

Figure 1:
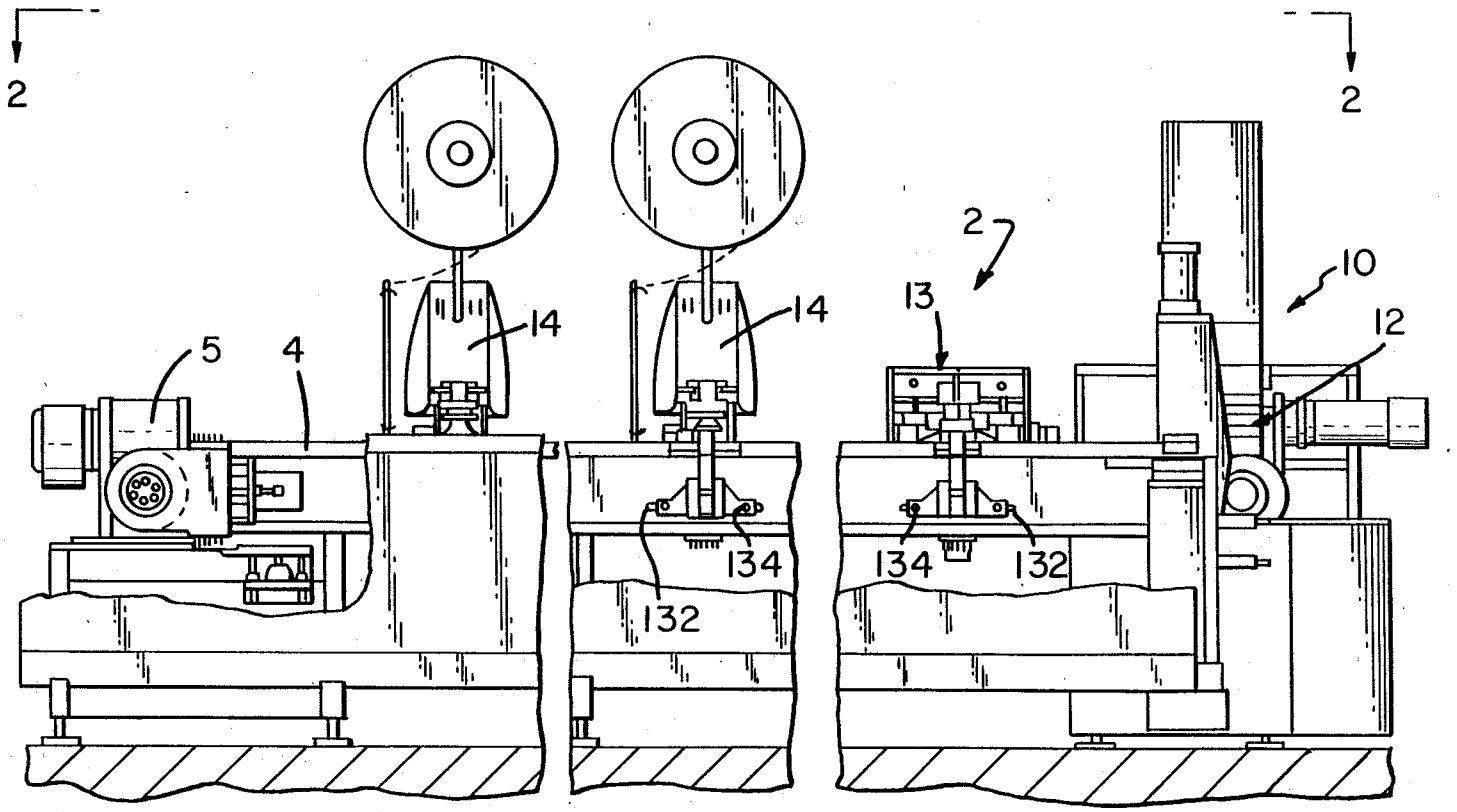
FIG. 1 is a frontal view of the harness making machine in accordance with the invention.
Figure 2:
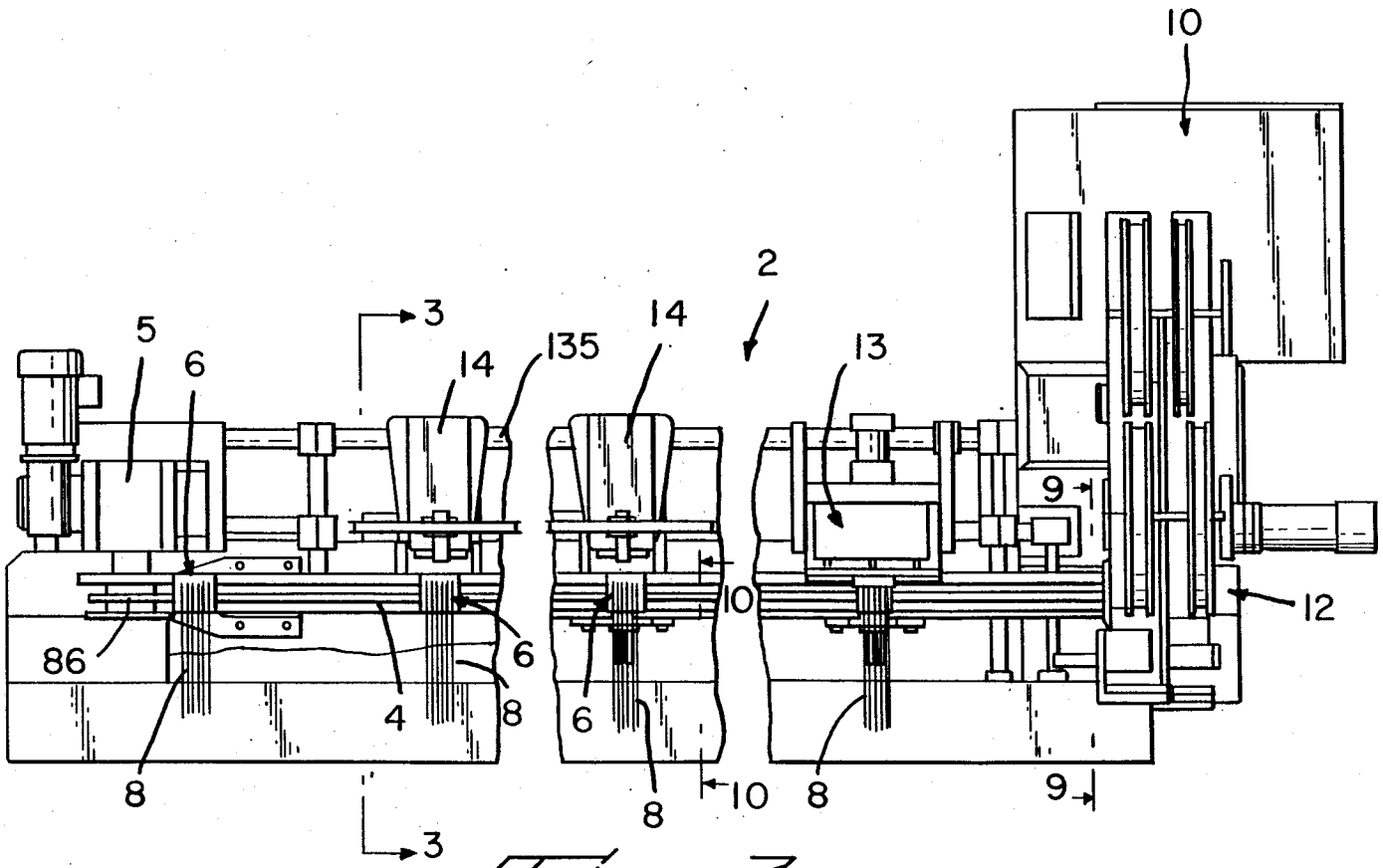
FIG. 2 is a top plan view of the machine of FIG. 1.
Figure 13:
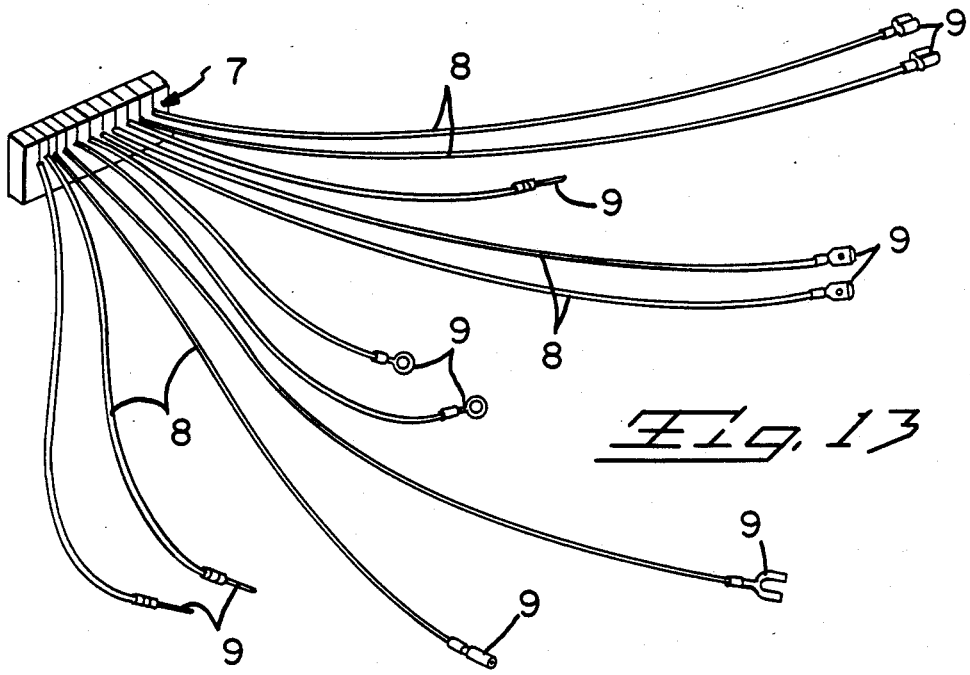

FIGS. 1 and 2 show a harness making machine 2 comprising a conveyor 4 which is indexed by a motor and drive train 5 and which has a plurality of wire jigs 6 thereon. Each of the wire jigs holds a plurality of wires 8 in side-by-side parallel relationship with the wire ends extending to one side of the conveyor. The wires are fed to the wire jigs at a loading station 10 and the embodiment shown also has an applicator 12 for installing a multicontact electrical connector 7 on the harness at one end thereof, see FIG. 13. The wire feeder 10 may be of the type shown in U.S. Pat. No. 4,043,494 and have the capability of feeding varying lengths of wires as indicated by the harness of FIG. 13. The applicator 12 may similarly be of any desired type.

The ends of the wires which are held in the wire jigs 6 are moved first to a wire stripper 13 at which insulation is stripped and are then moved to a plurality of crimping machines 14 at which terminals 9 are crimped onto the ends of the wires. Different types of terminals can be crimped onto the wires at the several processing stations or crimping machines 14 as desired.

In the description which follows, an individual wire jig 6 will first be described in detail and the features of the harness making machine which are essential is an understanding of the invention will then be described.

As shown in FIG. 4–8, each wire jig comprises a frame or support 16 having a wire clamping assembly 18 supported on its upper surface 20. The wire clamping assembly comprises a plurality of individual wire clamps 22, each of which is capable of holding at least one wire with the wire end extending to the one side of the conveyor along which the processing machines 14 are located.

Figure 6:
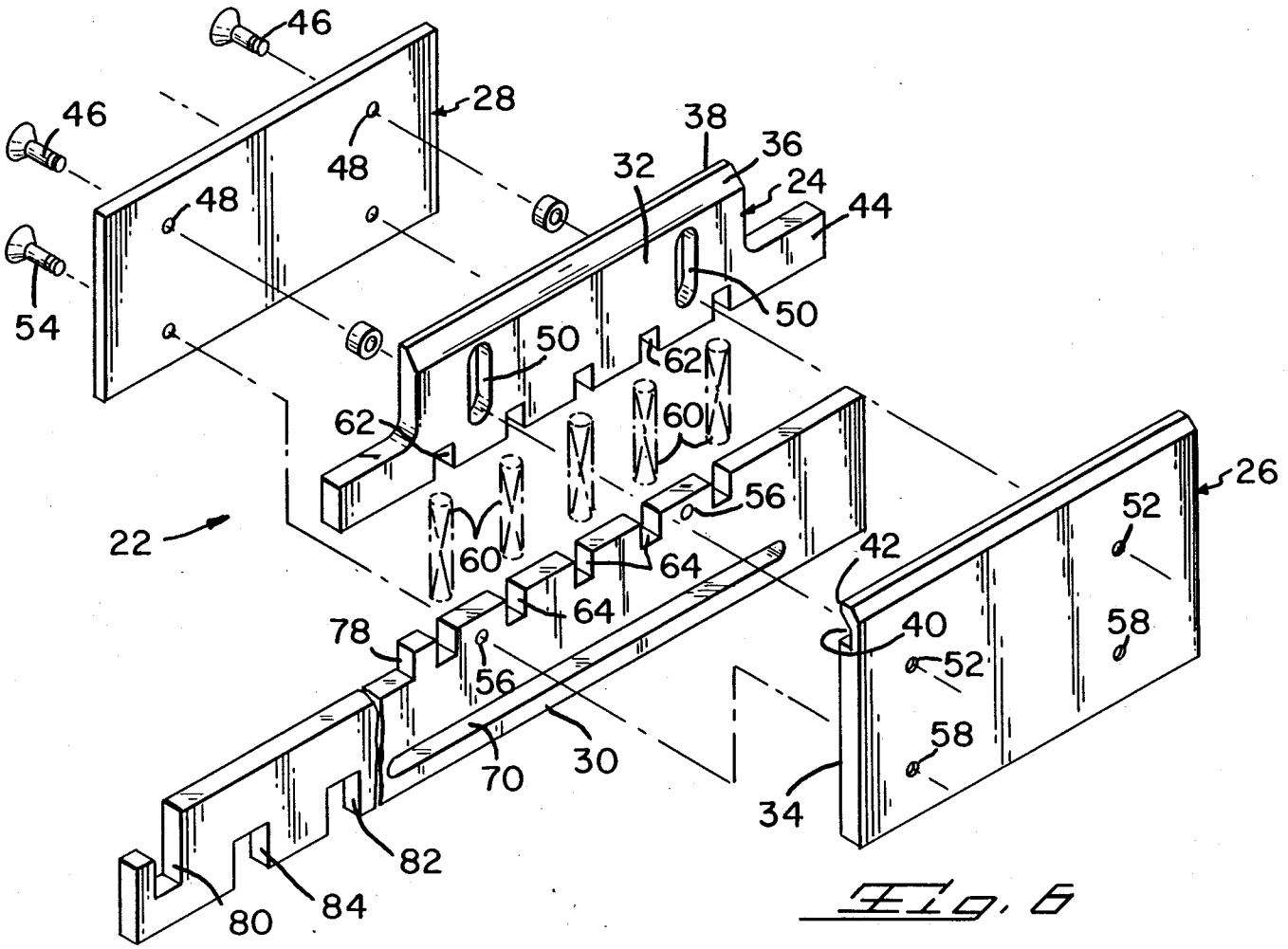
FIG. 6 is a perspective view of the clamp with the parts exploded from each other.
Figure 7:
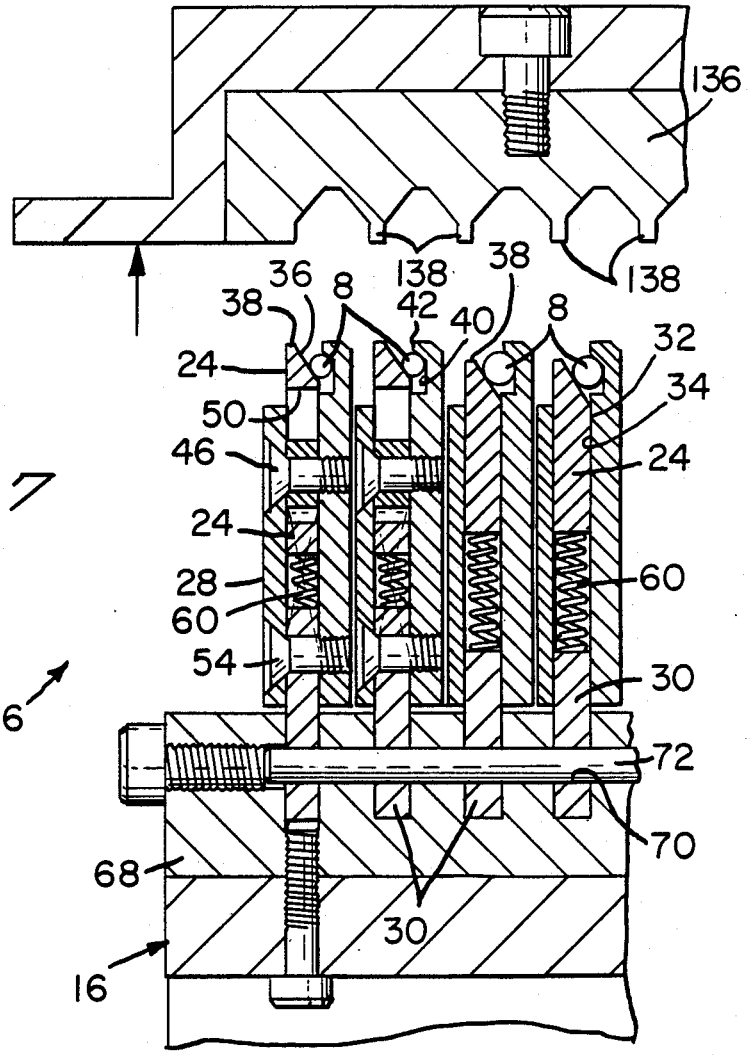
FIG. 7 is a cross section looking in the direction of the arrows 7—7 of FIG. 4 and showing also portions of a clamp opening member, this view showing the positions of the parts when wires are clamped in the individual clamps of the wire jigs.
Figure 8:
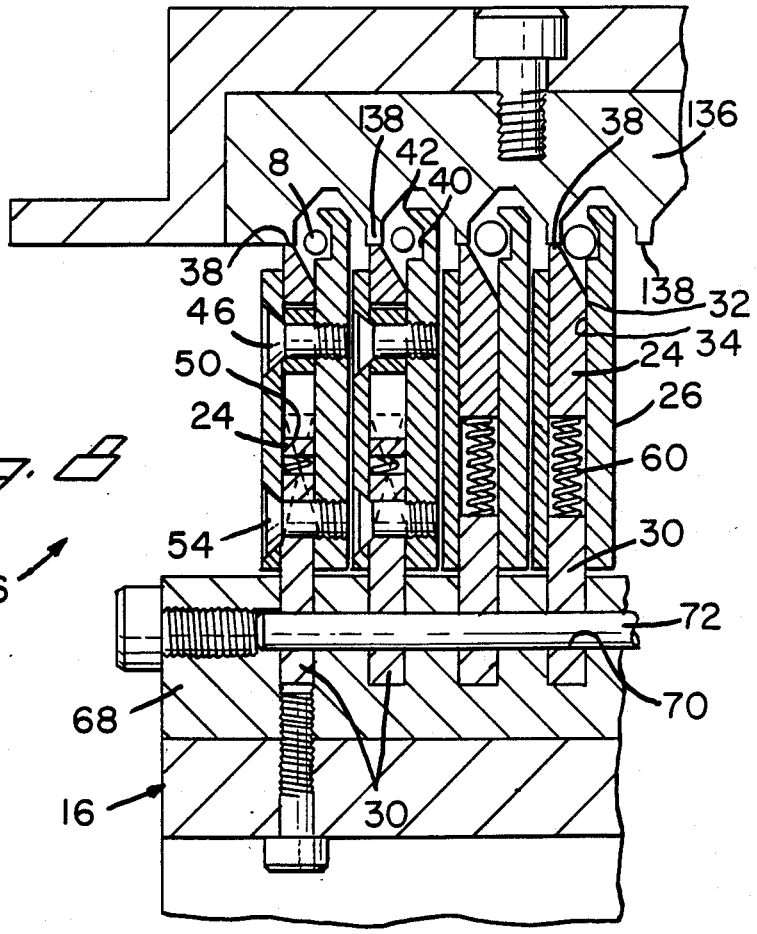
FIG. 8 is a view similar to FIG. 7 but showing the positions of the parts when the clamps are in their open positions.

Each individual wire clamp 22 comprises a first wire clamping plate 24, a second wire clamping plate 26, a retaining plate 28, and a slide member 30, see FIG. 6. The first and second wire clamping plates 24, 26, and opposed surfaces 32, 34 and the upper portion of the surface 32 is beveled as shown at 36 adjacent to the top side edge 38 of plate 24. The surface 34 of the second plate 26 has a groove or pocket 40 extending thereacross of its upper end and a ledge 42 extends over this groove. As shown in FIGS. 7 and 8, the beveled surface 36 and the pocket or groove 40 provide wire clamping surfaces which are capable of clamping wires of varying diameters.

The retaining plate 28 is secured to the slider 30 and to the second clamping plate 26 by means of screws 46, 54. The screws 46 extend through holes 48 in plate 28, through slots 50 in the first clamping plate 24, and are threaded into openings 52 in the second clamping plate 26. The screws 54 extend through holes in retainer plate 28, through holes 56 in the slide 30, and are threaded into openings 58 in the second clamping plate 26. The first clamping plate 24 is loosely held between the retainer plate and the second clamping plate and is captured by the screws 46 which permit vertical movement of plate 24 relative to the other parts of the clamp. Plate 24 is biased upwardly by springs 60 which are received in notches 62 in the lower edge of plate 24 and by notches 64 in the upper edge of the slider 30. As indicated by FIGS. 7 and 8, the first clamping plate 24 can be moved downwardly to the position FIG. 8 to permit placement of the wires in the wire clamp. The wires are thus clamped by the springs 60 which bias the plates 24 upwardly.

Figure 4:
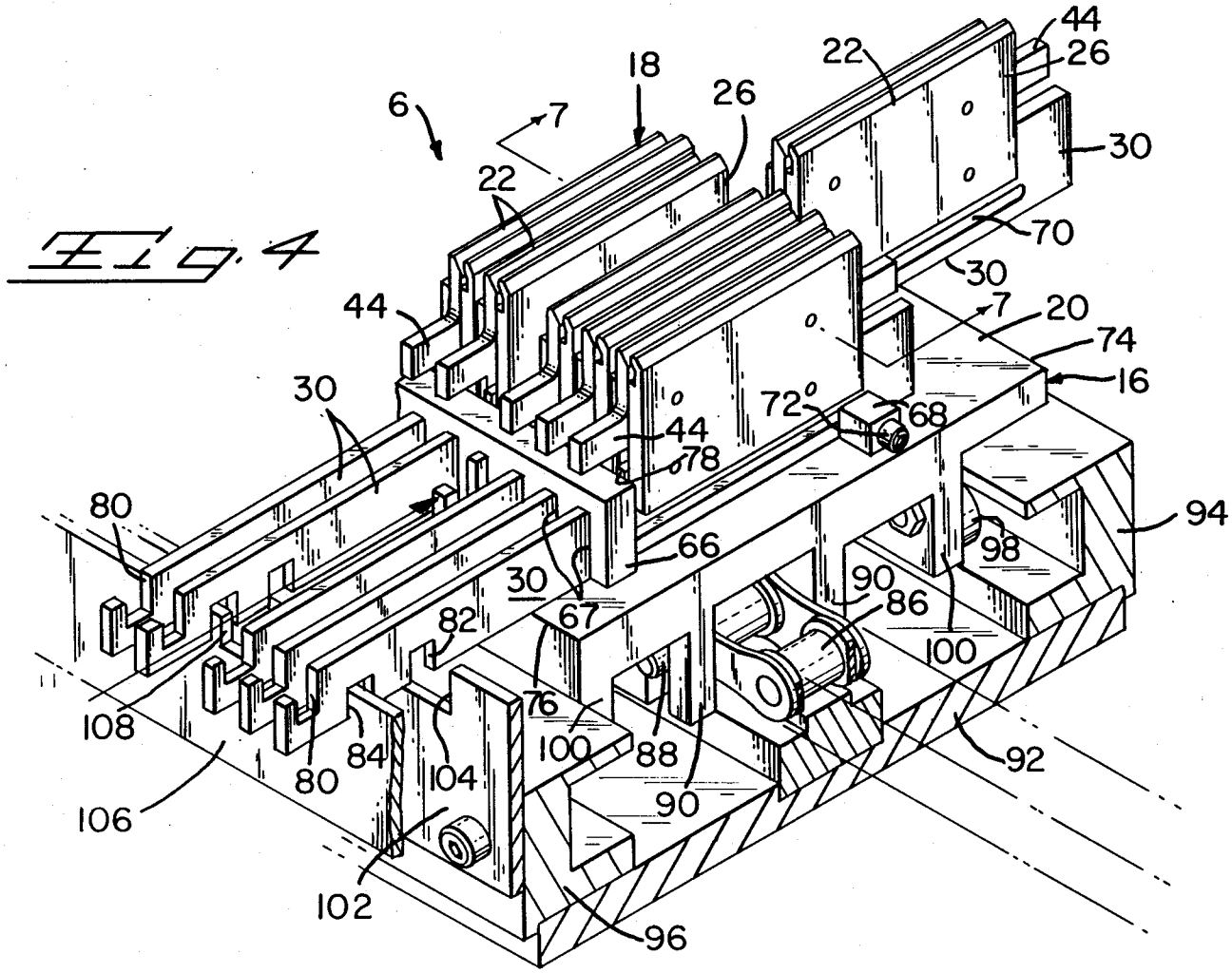
FIG. 4 is a perspective view of an individual wire jig of the type provided on the machine of FIGS. 1–3.
Figure 5:
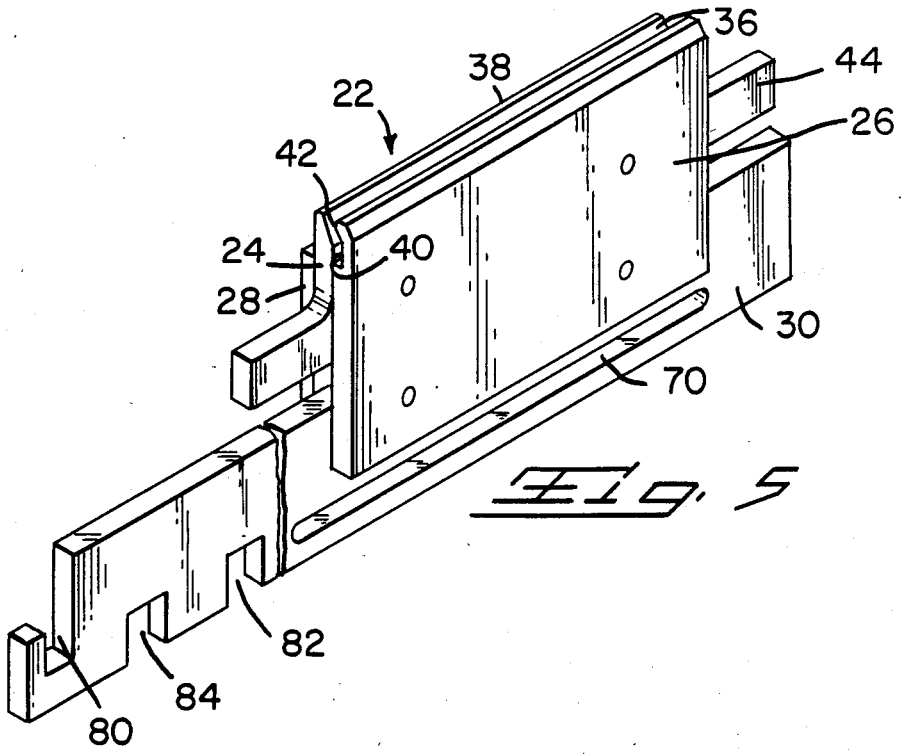
FIG. 5 is a perspective view of a wire clamp.
Figure 9:
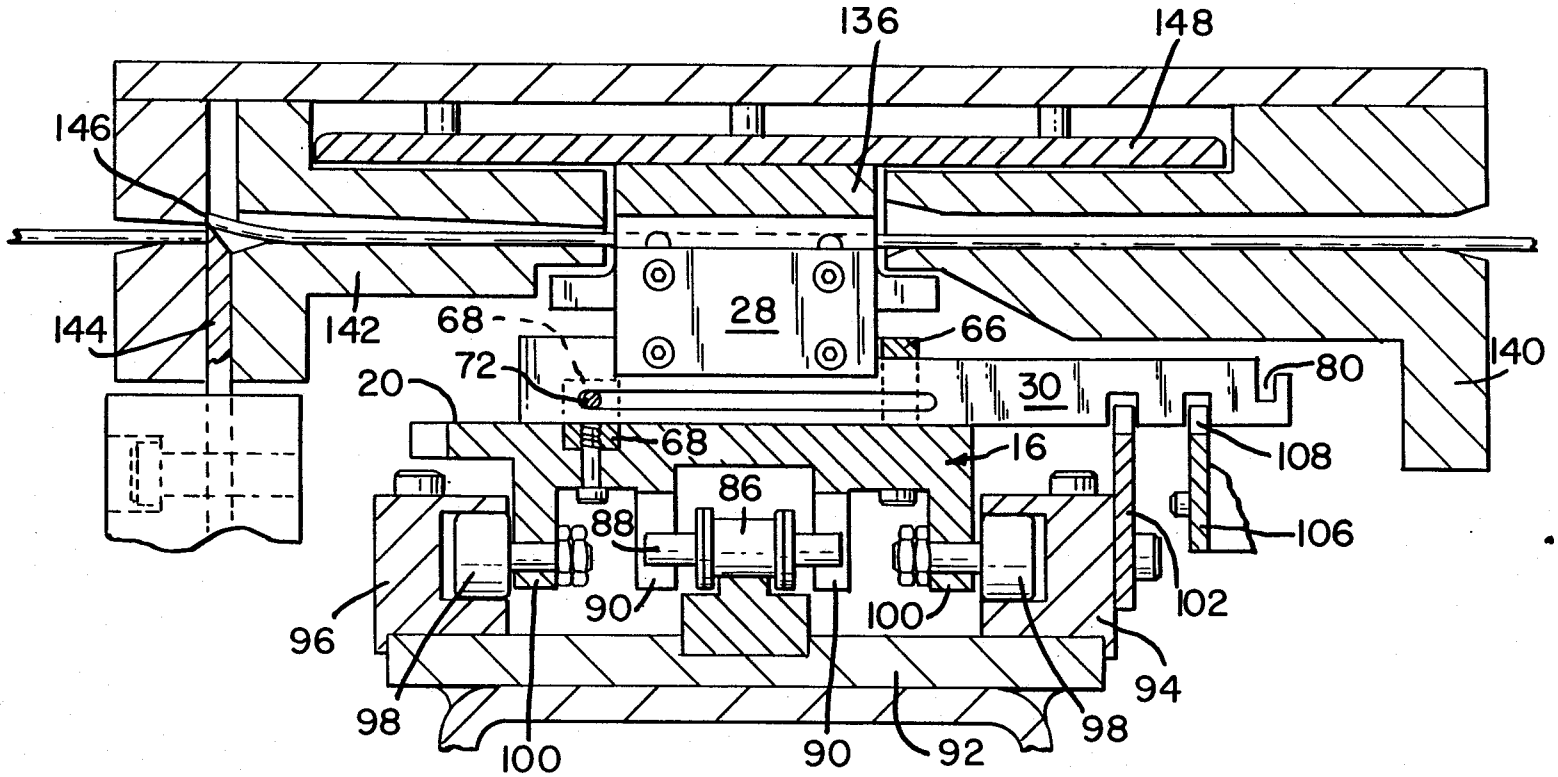
FIG. 9 is a view looking in the direction of the arrows 9—9 of FIG. 2 and showing the manner in which wires are fed to the wire jigs.

As shown in FIGS. 4 and 9, the individual wire clamps are maintained in a stack on surface 20 by retaining their guide members 66, 68 which are bolted to the upper surface 20 of the frame 16. The retainer 66 has spaced apart slots 67 therein which receive the slide members 30, a shoulder 78 being provided on each slide to limit leftward movement of the clamps beyond the positions shown on FIG. 4. The guide 68 is fitted in a recess in the frame, see FIG. 9, and has upstanding ears between which the forward portions of the slides 30 are received. Each slide 30 has an elongated slot 70 extending parallel to its lower edge and a rod 72 which is supported in the guide 68 extends through this slot. This slot 70 therefore limits rightward movement of the individual clamps when they are moved to their extended positions as will be described below.

Figure 10:
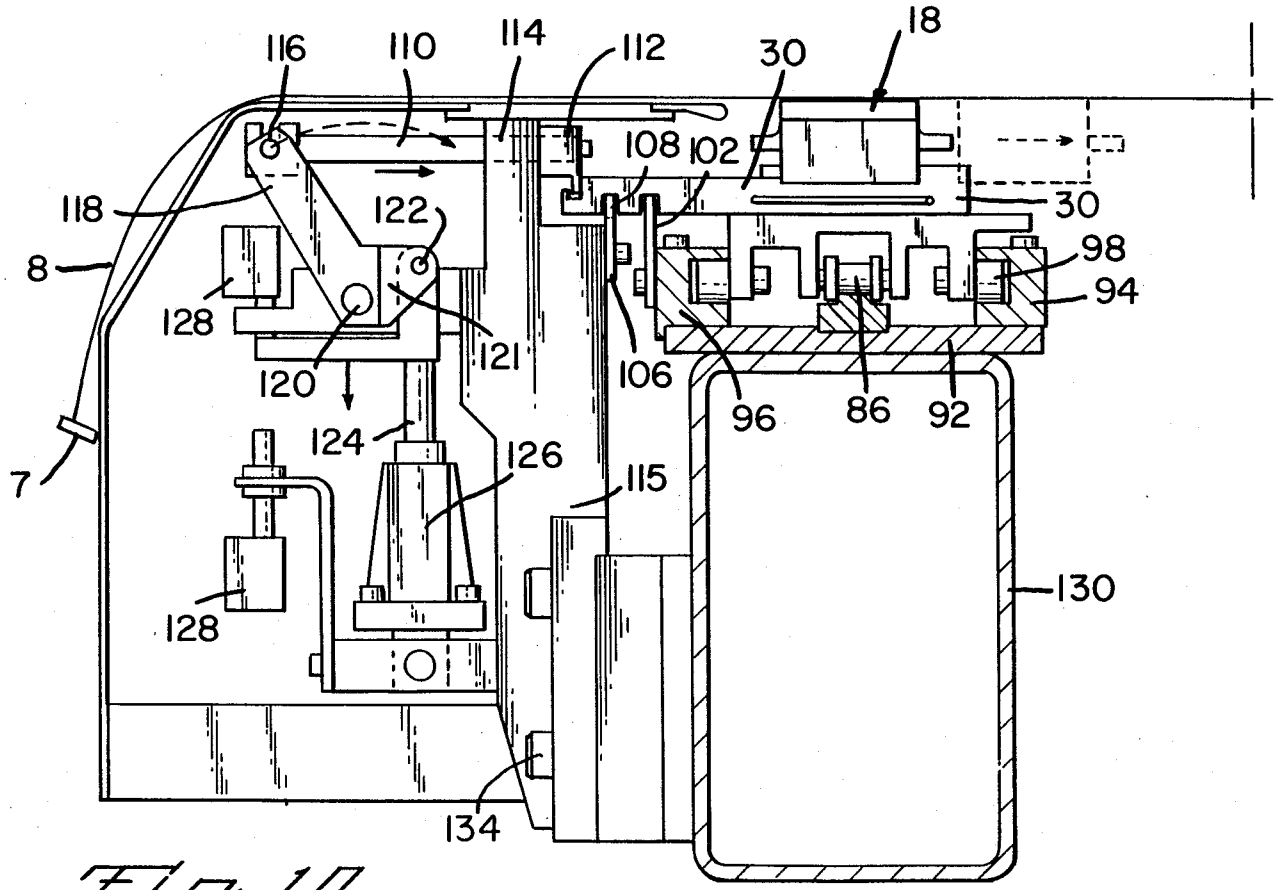
FIG. 10 is a view looking in the direction of the arrows 10—10 of FIG. 2 and showing a mechanism for moving an individual wire clamp to its extended position.

Each slide 30 has a notch 80 at its left-hand end as shown in FIG. 4 by means of which it is coupled by a clamp actuator shown in FIG. 10 and each slide has spaced apart notches 82, 84 in its lower edge which receives rails 102, 106 as shown in FIG. 9. The rail 102 extends along the entire conveyor path and maintain all of the wire clamps in a single stack when a wire jig is being moved between two adjacent processing machines 14. The rail 102 has an enlarged notch 104 at each of the processing machines so that all of the wire clamps 22 are free move to their extended positions.

Rails 106 are provided only at the processing machines 14 and are received in the notches 84 of the slides 30. The rails 106 are provided with a notch 108 which is in alignment with the slider 30 of the particular wire clamp which is to be moved to its extended position at a particular station. The rail 106 is thus programmed to prevent movement of those wire clamps which are to remain in the stack while one clamp is advanced as shown in FIG. 4. If desired, two or more clamps can be moved simultaneously at any one of the stations on the conveyor path.

The conveyor may be of any desired type and is shown and described only to the extent necessary for an understanding to present invention. The conveyor shown comprises a chain 86 having pins 88 which are received in slots in depending ears 90 on the underside of the frame 16. The chain 86 is supported on a rail which is centrally mounted on a support plate 92 which has opposed channel members 94, 96 on its side edges. Additional support for the frame 16 of the jig is provided by rollers 98 which are received in the channels and which are supported by ears 100 on the underside of frame 16.

Figure 3:
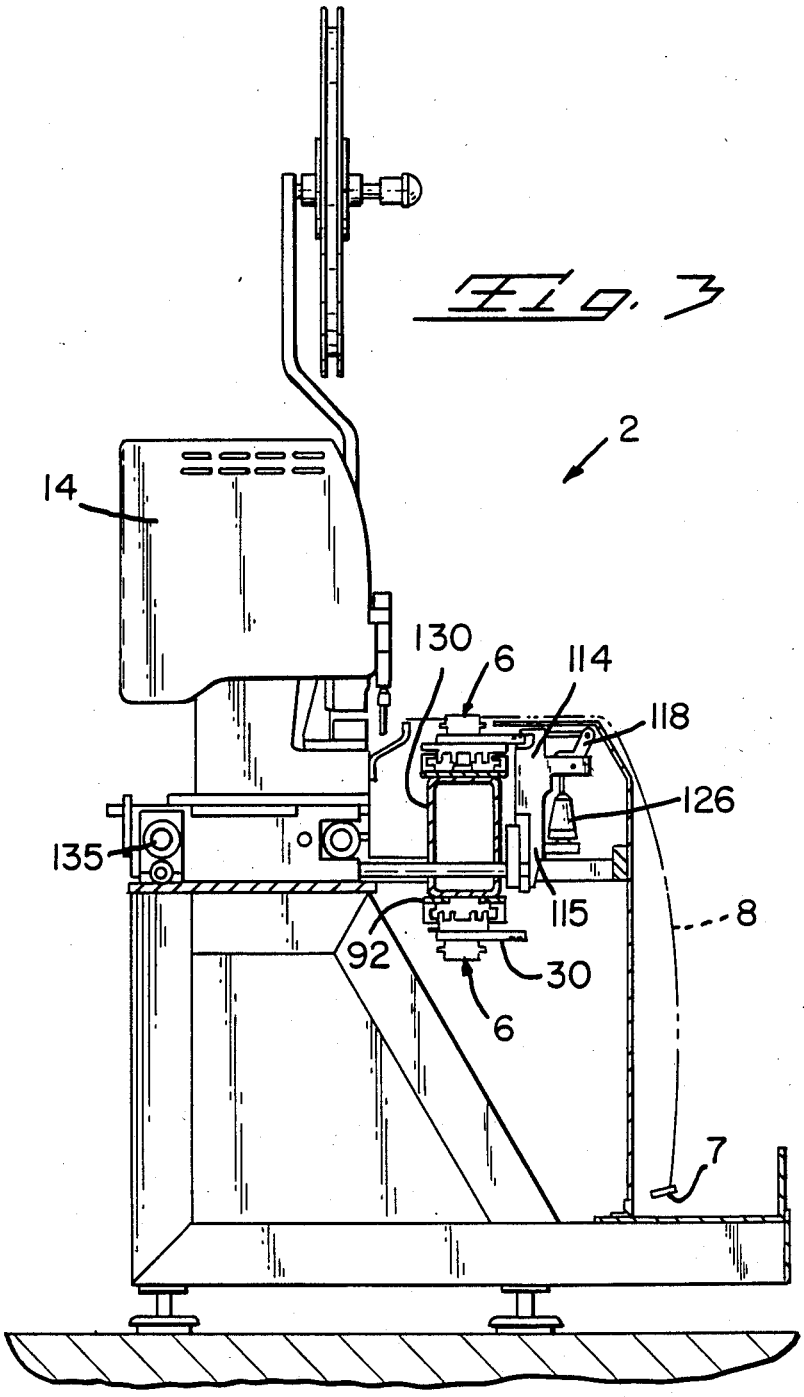
FIG. 3 is a view looking in the direction of the arrows 3—3 of FIG. 2.

Referring now to FIGS. 3 and 10, the actuator for moving an individual clamp to its extended position comprises an actuator rod 110 having a coupling 112 on its end which is received in the notch 80 of the appropriate slide member 30. The rod 110 is supported at 114 in a supporting frame 115 which in turn is secured to a tubular support 130 on which the plate 92 is supported. Rod 110 has a pin-slot coupling 116 to one arm 118 of a bell crank. The bell crank is pivoted at 120 and its other arm 121 is pivotally connected at 122 to a piston rod 124 which extends from a piston-cylinder 126. When the piston rod 124 is moved downwardly from the position shown in FIG. 10, actuator rod 110 is moved rightwardly and the wire clamp to which the rod is coupled is moved to its extended position. In this manner, the wire held in the clamp is selectively presented to a crimping machine or other wire processing machine 14. Limit switches as shown at 128 may be located adjacent to the moving parts to control the crimping press or otherwise control operation of the harness making machine.

Each of the actuators for advancing an individual wire clamp 22 is adjustably mounted on the machine by bolts 134 which extend through slots 132, see FIG. 1. The actuator can thus be moved by a slight distance so as to place it in alignment with the particular wire clamp 22 which is to be advanced. Additionally, the processing machines 14 can be adjustably mounted on rails 135 as shown in FIG. 2.

As mentioned previously, the wire feed 10 and the applicator 12 for installing the connector 7 on the wires can be any suitable type. FIGS. 7–9 show the manner in which the wires can be fed to the wire clamp and cut by a cutting means adjacent to the applicator 12.

To move the first clamping plates 24 downwardly, a depressor 136 is provided which has spaced apart projection 138 that engage the upper edges 38 of the first clamping plates 24 of each wire clamp. When this depressor 136 is in its lowered position, FIG. 8, a confined passageway is formed through which the wires can be fed. When the depressor 136 is moved upwardly to the position of FIG. 7, the first clamping plates 24 move upwardly and clamp the wires as shown in FIG. 7. The wires are guided by suitable guides 140, 142 and a cutting blade 144 is provided which cooperates with a cutting edge 146 to cut the wires at a location adjacent to the wire jig. In the embodiment shown, the depressor 136 is moved downwardly by a pressure plate 148.

The wire guides 140, 142 are capable of being opened or moved apart so that after cutting the wires, the conveyor can be indexed onto the wires moved laterally of their axes from the vicinity of the wire feed 10 and connector applicator 12 to the insulation stripper 13 and then to the processing machines 14.

Figure 11:
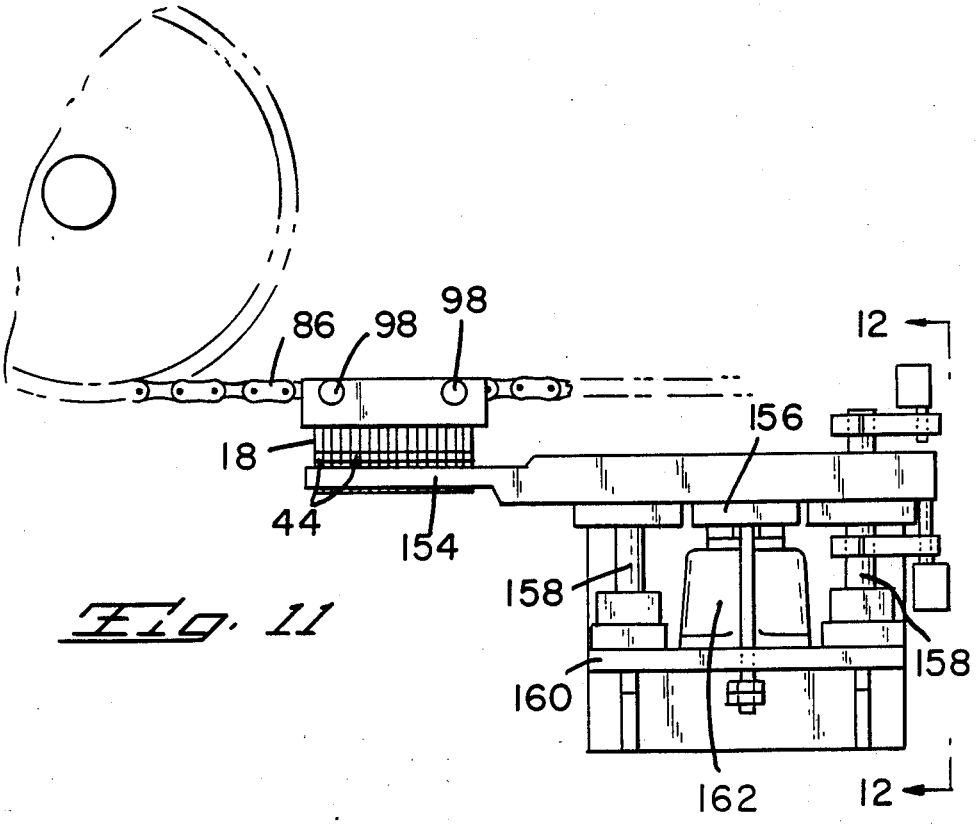
FIG. 11 is an enlarged side view of the unloading station of the machine at which wires held in a wire jig are released.
Figure 12:
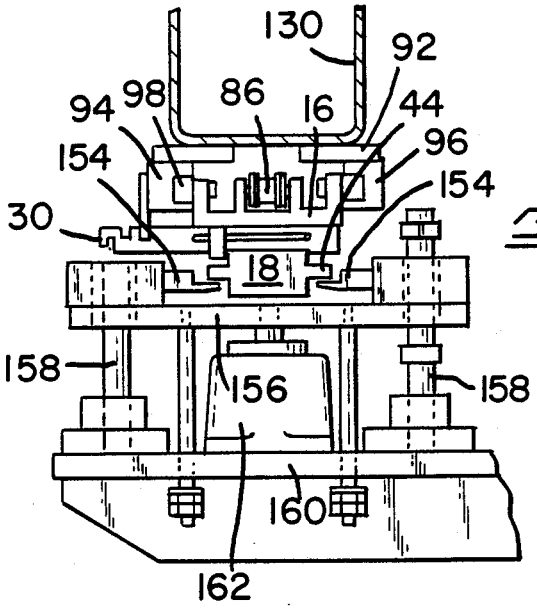
FIG. 12 is a view looking in the direction of the arrows 12—12 of FIG. 11.

FIGS. 11 and 12 show an unloading mechanism to open the wire clamps at an unloading station which is shown on the left in FIG. 1 adjacent to the conveyor drive 5. The unloading station is located on the underside or return side of the conveyor and comprises a pair of spaced apart cantilever members 154 which engage extensions 44 of the movable clamping plates 24. The bars 154 extend from a mounting plate 156 which is slidably supported on parallel rods or columns 158 that extend from a fixed support 160. The plate 156 can be moved upwardly a slight distance from the position shown in FIG. 13 so that the movable clamping plates are moved upwardly by cantilever members 154 and the wires released. The wires will then fall downwardly and be collected in a suitable bin.

The finished harness can alternatively be removed from the wire jigs by a robot device which would open the wire clamps and transport the harness to a suitable receiving location.

The method of the present invention can be carried out with the machine described above and shown in the accompanying drawing or with any one of several other known machines provided, of course, a suitable means such as a wire jig is provided on the machine for individually moving the wires axially from the array at each crimping machine. The following issued U.S. Patents describe machines and/or wire feeding mechanisms which can be used in the practice of the invention: U.S. Pat. Nos. 4,164,808; 4,380,117; 4,404,743; 4,354,626. Each of these prior art patents is hereby incorporated by reference into this specification in its entirety.

As noted previously, the wire feeding step can be carried out by a feeding means as described in U.S. Pat. No. 4,043,494 and it can also be carried out by means of the above-identified U.S. Pat. No. 4,354,626. The remaining U.S. patents cited above show harness-making machines of the general type having a conveyor and having wire jigs or fixtures on the conveyor which hold a plurality of wires so that the wires can be presented to a processing machine along the path of movement of the conveyor.

If it is desired to install a multicontact electrical connector as shown at 7 in FIG. 13 on one end of the harness and discrete terminals 9 on the other end, the insertion apparatus for the multicontact electrical connector can be of any of the many well-known types. For example, the above-identified U.S. Pat. No. 4,404,743 shows one type of inserter for simultaneously inserting a plurality of wires into the terminals in a multicontact electrical connector and another type of inserter is shown in U.S. Pat. No. 4,136,440 which is hereby incorporated by reference in its entirety. In order to install a multicontact electrical connector 7 on the ends of the wires, it is merely necessary to move all of the clamps of the wire jig laterally at the one station at which the insertion apparatus is provided. In this manner, all of the wires will be moved into alignment with the terminals in the multicontact electrical connector and can be inserted by suitable insertion punches.

We claim:

1. A method of manufacturing an electrical harness of the type comprising a plurality of discrete wires, each wire having a first end and a second end, the first ends having first terminals thereon, at least some of the first terminals being discrete terminals, the method comprising the steps of:

feeding the discrete wires from substantially endless sources to extend through, and beyond, a first loading zone in such a way that the wires are in side-by-side coplanar parallel relationship in a first array in the first loading zone, clamping the first array of wires in the first loading zone after cessation of the feeding step and cutting the wires at a location adjacent to and upstream, relative to the direction of wire feed, from the first loading zone thereby producing the first and second wire ends, the first ends being the cut ends of the first array, intermittently moving the first array of wires laterally of the axes of the wires along a first conveying path past a succession of first individual wire processing machines such as terminal crimping machines, and pausing at each of the individual processing machines, moving at least one selected wire axially from the array towards the individual wire processing machine at which said array of wires is paused and performing an operation on the at least one wires such as crimping a terminal onto the at least one wire.

2. A method as set forth in claim 1 comprising feeding wires past the first loading zone to a second loading zone, and clamping the wires at the second loading zone in a second array with the second ends of the wires spaced from the location at which the wires are clamped.

3. A method as set forth in claim 2 comprising moving the second array of wires intermittently laterally of their axes along a second conveying path which is substantially parallel to the first conveying path.

4. A method as set forth in claim 3 comprising moving the second array of wires past a second succession of individual wire processing machines and moving at least one wire axially from the second array to one of the second individual wire processing machines while the second array is located adjacent to the one second individual wire processing machine.

5. A method as set forth in any one of claims 1–4 comprising feeding the discrete wires by varying amounts during the wire feeding step whereby the wires in the finished harness are of varying lengths.

6. A method as set forth in claim 1 comprising connecting the second ends of the wires to the terminals in a multicontact electrical connector.

7. A method of making an electrical harness in comprising the step of feeding a plurality of wires to a wire jig mounted on a conveyor, cutting the wires at a location adjacent to the jig so that the jib holds a plurality of wires in an array in side-by-side aligned parallel relationship to each other, and indexing the conveyor and presenting the wires to a terminating machine, the method further comprising the steps of:

indexing the conveyor repeatedly and the positioning of the jig adjacent to a plurality of terminating machines, at each terminating machine selectively moving one wire axially from the array and presenting it to the terminating machine crimping a terminal onto the one wire, and then moving the one wire axially back into the array.

* * * * *